US012163324B2

(12) United States Patent
Keane

(10) Patent No.: US 12,163,324 B2
(45) Date of Patent: Dec. 10, 2024

(54) TOILET DRAIN LINE OUTLET PORT SHIELD SYSTEM AND METHODS OF USE

(71) Applicant: 246 Home LLC, Andover, MN (US)

(72) Inventor: Nicholas Keane, Andover, MN (US)

(73) Assignee: 246 Home LLC, Andover, MN (US)

( * ) Notice: Subject to any disclaimer, the term of this patent is extended or adjusted under 35 U.S.C. 154(b) by 178 days.

(21) Appl. No.: 17/943,575

(22) Filed: Sep. 13, 2022

(65) Prior Publication Data

US 2023/0078648 A1 Mar. 16, 2023

Related U.S. Application Data

(60) Provisional application No. 63/243,861, filed on Sep. 14, 2021.

(51) Int. Cl.
*E03D 11/13* (2006.01)

(52) U.S. Cl.
CPC ..... *E03D 11/13* (2013.01)

(58) Field of Classification Search
CPC ..... A47K 1/14; B62B 3/10; B65D 59/00–08; E03C 1/182; E03C 1/33–335; E03C 11/00; E03C 11/02; E03C 11/13–135; E03C 11/14–146; E03C 11/16; E03C 11/17; E03D 2201/00; F16L 2201/80; F16L 23/003–006; F16L 55/11–1141; F16L 55/115–1157; F16L 57/00–005; G01M 3/022
See application file for complete search history.

(56) References Cited

U.S. PATENT DOCUMENTS 4,233,697 A * 11/1980 Cornwall ..... E03D 11/16 4/293
5,184,653 A * 2/1993 Lacy ..... E03D 11/00 141/98
5,329,971 A 7/1994 Condon
5,377,361 A 1/1995 Piskula
5,425,466 A 6/1995 Bambacigno
5,437,309 A 8/1995 Timmons
7,231,674 B1 * 6/2007 Cernik ..... B62B 1/26 280/47.17
8,313,130 B2 * 11/2012 Hazel ..... E03D 11/135 294/144
9,091,048 B2 * 7/2015 Arthurs ..... E03D 9/00
9,631,761 B1 4/2017 Arthurs et al.
9,869,081 B1 1/2018 Pardo, Jr.
(Continued)

*Primary Examiner* — Erin Deery
*Assistant Examiner* — Nicholas A Ros
(74) *Attorney, Agent, or Firm* — Dicke, Billig & Czaja, PLLC

(57) ABSTRACT

A shield system for installation to a toilet bowl for temporarily covering an outlet port of the toilet bowl. The shield system includes a support assembly, a membrane, and a mounting assembly. The support assembly includes a base piece defining a central aperture sized to receive the outlet port. The membrane is connected to the base piece and extends across the central aperture. The mounting assembly is configured for securing the shield system to the toilet bowl in a region of the outlet port (e.g., to a base of the toilet bowl), and can include two threaded bolts. In an installed arrangement, the membrane is secured over the outlet port in liquid tight manner, serving to prevent discharge of contained water from the toilet bowl.

19 Claims, 13 Drawing Sheets

(56) References Cited

U.S. PATENT DOCUMENTS

| | | | | |
|---|---|---|---|---|
| 9,995,030 | B1 | 6/2018 | Jimenez | |
| 10,174,783 | B1 | 1/2019 | Nichols | |
| 2017/0167126 | A1* | 6/2017 | Arthurs | F16L 55/115 |
| 2020/0284017 | A1 | 9/2020 | Duncan | |

* cited by examiner

TOILET DRAIN LINE OUTLET PORT SHIELD SYSTEM AND METHODS OF USE

CROSS-REFERENCE TO RELATED APPLICATIONS

This U.S. Patent application claims the benefit of the filing date of U.S. Provisional Patent Application Ser. No. 63/243,861, filed Sep. 14, 2021, the entire teachings of which are incorporated herein by reference.

BACKGROUND

The present disclosure relates to systems and methods for convenient and clean storage of toilets. More particularly, it relates to easy-to-install systems for covering a drain line outlet port of a toilet following removal of the toilet from a bathroom's waste pipe flange, and related methods of use.

The temporary storage and/or transport of a toilet following removal from a bathroom's waste water pipe can be problematic. Stored water and other materials may undesirably spill or otherwise transfer from the toilet onto surrounding surfaces. Any efforts to address these and related concerns will be well-received.

DETAILED DESCRIPTION

Some aspects of the present disclosure relate to a low cost, easy-to-install system or device for shielding the drain outlet port of a toilet.

Figure 1:
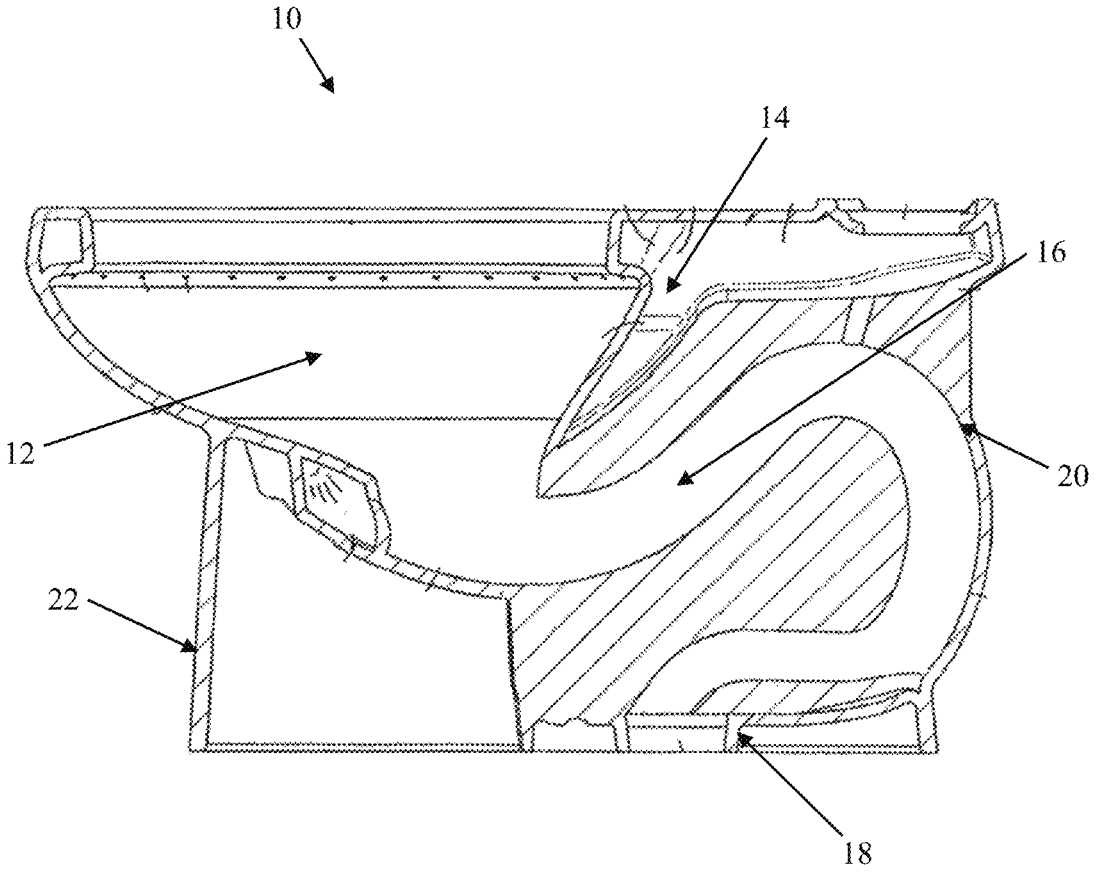
Prior Art FIG. 1
FIG. 1 is a simplified cross-sectional view of a conventional toilet bowl.

As a point of reference, toilets are very well known, and can take various forms. One major component of virtually all toilet designs is typically referred to as a bowl. The bowl generally consists of a cast outer housing (e.g., porcelain) forming an interior reservoir for holding water, inlet passages or pathways for directing clean water into the reservoir, and outlet pathways for directing water and waste from the reservoir to an outlet. Clean water can be supplied to the bowl in different ways. Commonly, a tank component is provided with the toilet and contains reserve water for refilling the bowl (along with devices for flushing the clean water into the bowl and refilling the tank). With these designs, the tank can be separately formed and subsequently assembled to the bowl, or the tank and bowl can be integrally formed as a unitary structure. Alternatively, with some tank-less designs, a building's water line is directly plumbed to the bowl. Regardless, the bowl's outlet pathway(s) (or "drain line") from the reservoir to the outlet typically defines one or more bends, serving to establish a trap (e.g., P-trap, S-trap, etc.) or siphon region that functions to maintain a water level in the reservoir. From the trap or siphon region, the drain line extends to an outlet opening. FIG. 1 provides a representation of a non-limiting example toilet bowl 10 with which the systems and methods of the present disclosure is useful. The toilet bowl 10 defines a reservoir 12. Inlet passages 14 direct fresh water to the reservoir 12, whereas a drain line 16 directs water from the reservoir 12 to an outlet port 18. The drain line 16 forms a bend region 20 (e.g., S-trap) between the reservoir 12 and the outlet port 18. The outlet port 18 typically has a cylindrical shape, and is recessed within and relative to a base 22 of the toilet bowl 10.

Figure 2:
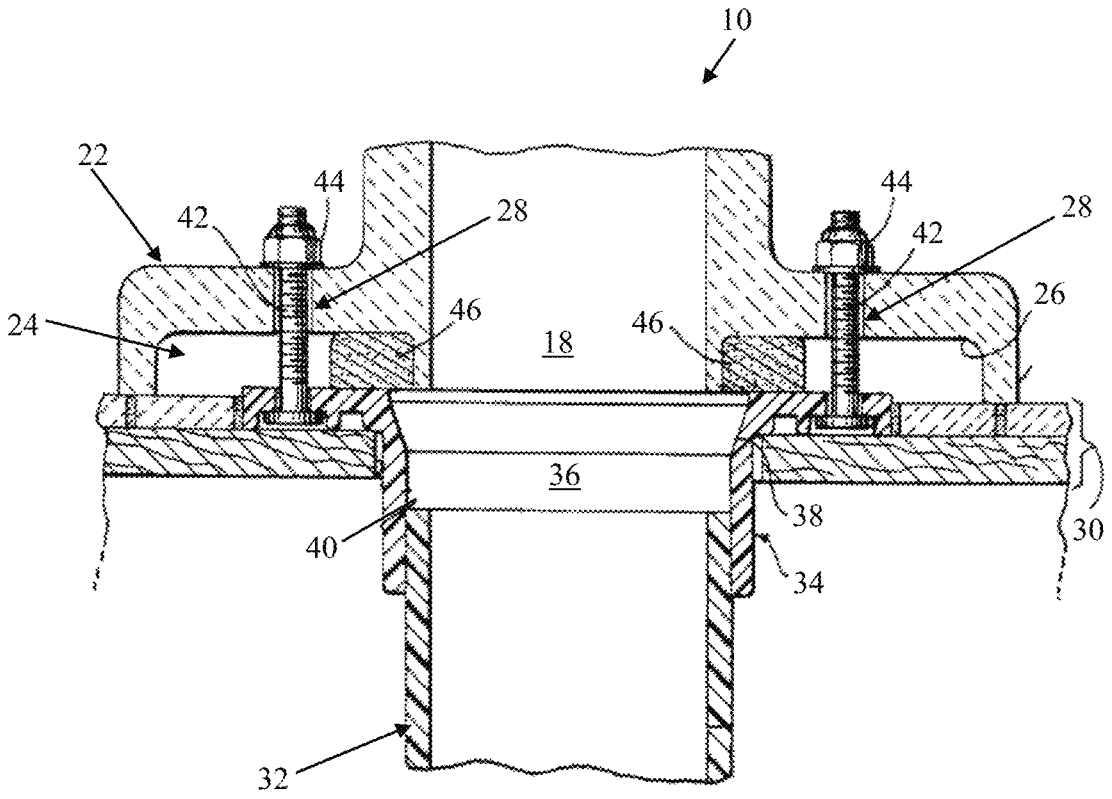
Prior Art FIG. 2
FIG. 2 is an enlarged cross-sectional view illustrating conventional illustration of a toilet bowl to a bathroom infrastructure.

Certain aspects of most modern day toilet bowls are designed for installation to the bathroom waste water infrastructure employed with the vast majority of homes and other buildings, for example dimensions and geometries of the drain line outlet port 18 and various mounting features. For example, FIG. 2 illustrates the toilet bowl 10 upon final installation. As shown, the outlet port 18 can project into an open interior region 24 formed by the base 22, extending from a shoulder 26. While a distance of a leading edge of the outlet port 18 from the shoulder 26 can vary across different styles of toilet bowls, the shape and dimensions of the outlet port 18 are normally standard. In particular, the outlet port 18 for the vast majority of toilet bowls is a cylindrical ring, with a diameter on the order of 3 or 4 inches. For reasons made clear below, bolt holes 28 are formed through the base 22, equidistantly spaced relative to a centerline of the outlet port 18 at a standard center-to-center distance of approximately 6 inches. The bathroom infrastructure includes a bathroom floor 30 and a waste water or soil pipe 32 extending to an opening in the floor 30. A flange (or "closet flange") 34 is secured to the waste water pipe 32, and is secured relative to the floor 30 in various manners. The closet flange 34 is structured to provide a passageway 36 from the outlet port 18 to the waste water pipe 32 upon final installation. For example, an upper region 38 of the passageway 36 can have a diameter greater than that of the of outlet port 18, and can taper in diameter to a lower region 40 for connection with the waste water pipe 32.

Conventionally, the toilet bowl 10 is installed to the closet flange 34, and thus secured relative to the bathroom floor 30, via two (or more) closet bolts 42. In this regard, the closet flange 34 forms bolt passages at standardized locations relative to one another (and relative to a centerline of the passageway 36) that matches the spacing of the bolt holes 28 in the base 22 as described above. Due to these standardized geometries and dimensions, the closet bolts 42 are readily inserted through the base 22 and the closet flange 34, dictating that the outlet port 18 is aligned with the closet flange passageway 36. A nut 44 is threadably connected to a corresponding one of the closet bolts 42, and is tightened to secure the bowl 10 to the closet flange 34 and thus relative to the floor 30. To ensure a fluid tight seal between the outlet port 18 and the closet flange 34, a wax ring 46 or the like is commonly applied about an exterior of the outlet port 18 (and/or onto the closet flange 34) immediately prior to placement of the toilet bowl 10 over the closet flange 34. With tightening of the nuts 44, the wax ring 46 is compressed between the shoulder 26 and a surface of the closet flange 34.

After installation and service, a user may desire to remove or "uninstall" the toilet bowl 10 from the bathroom floor 30 and the closet flange 34 (e.g., temporary removal of the toilet bowl 10 as part of a bathroom remodeling project, permanent removal/replacement, etc.). With reference between FIGS. 1 and 2, removal of the toilet bowl 10 is relatively straightforward. Water supply to the toilet bowl 10 is disconnected and efforts are made to remove as much contained water from the reservoir 12 as possible. The nuts 44 are removed from the closet bolts 42 so that the toilet bowl 10 can be lifted. Once lifted off of the closet bolts 42, the user typically needs or desires to place the bowl 10 on the floor in a nearby area. The so-removed toilet 10 may remain at this temporary location, or may be moved to another locale. Regardless, residue from the wax ring 46 remains on the outlet port 18 following removal from the closet flange 34; this wax ring residue will invariably come into contact with and soil the floor (and perhaps other surfaces) at which the toilet bowl 10 is placed. Further, while as much water as possible will have been removed from the reservoir 18, invariably a substantive volume of water remains in the bend region 20. As the toilet bowl 10 is jostled during removal, this retained water can be caused to drain to and through the outlet port 18, spilling onto the floor and surrounding areas.

Figure 3:
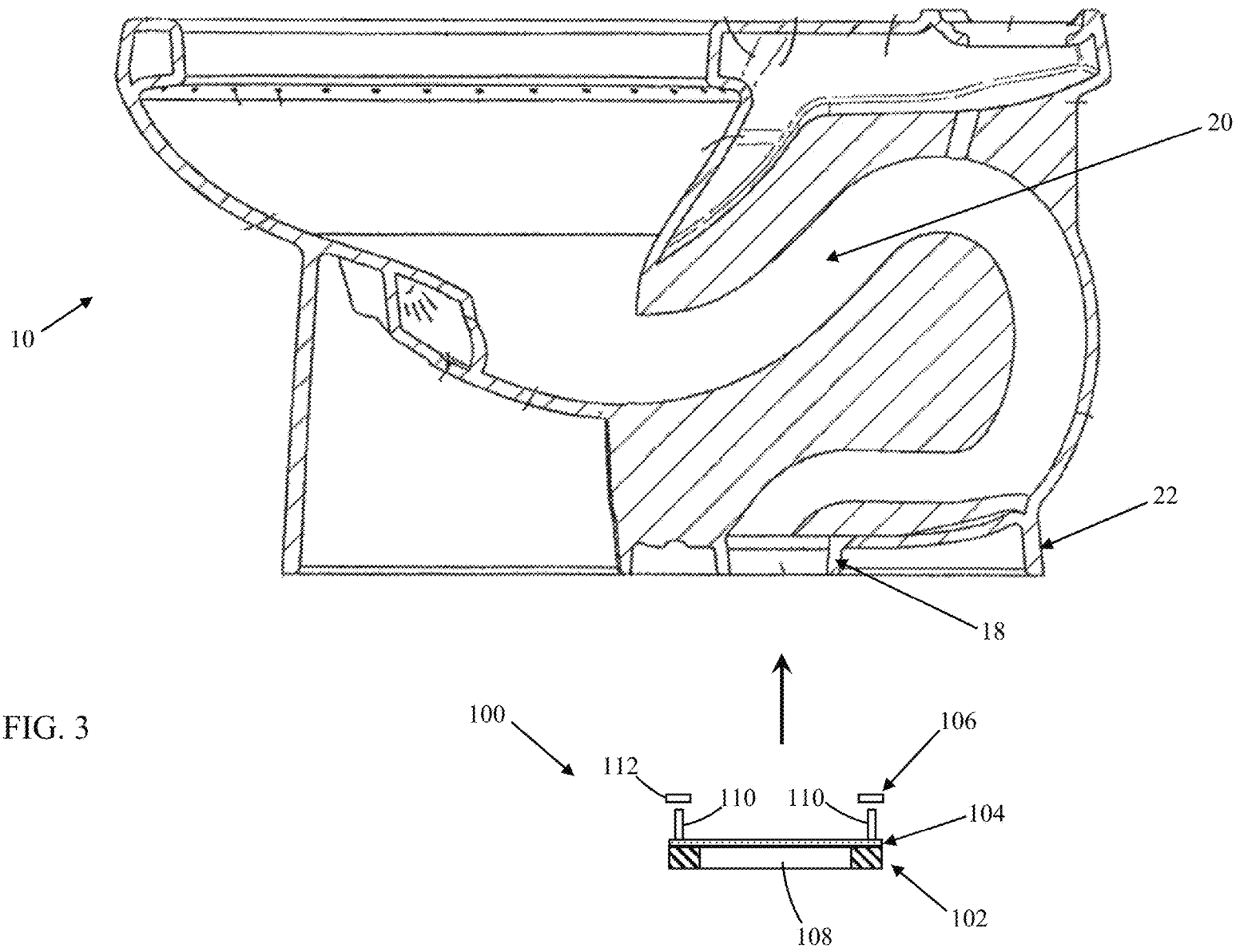
FIG. 3 schematically illustrates a shield system of the present disclosure relative to a conventional toilet bowl.

Against the above background, the shield systems and related methods of use of the present disclosure are useful for preventing the instances of soiling/water spill described above for a removed or "uninstalled" toilet bowl. As schematically shown in FIG. 3, shield systems 100 of the present disclosure include a support assembly 102, a membrane 104, and a mounting assembly 106 (referenced generally). In general terms, the support assembly 102 supports the membrane 104, and the membrane 104 is configured to effect a liquid tight seal with the outlet port 18. The mounting assembly 106 promotes temporary attachment of the shield system 100 to the toilet bowl 10 in a manner that readily locates the membrane 104 over the outlet port 18.

The support assembly 102 can assume various forms, and can include or comprise one, two, or more bodies as described below. The support assembly 102 provides a relative rigid and flat base layer(s) for supporting and maintaining the membrane 104 along at least a perimeter thereof. Further, the support assembly 102 can form a clearance aperture 108 for reasons made clear below. In general terms, a size and shape of the clearance aperture 108 is selected to accommodate the expected outer dimensions of the outlet port 18 (e.g., the clearance aperture 108 can be hole with a diameter of at least 3 or 4 inches).

The membrane 104 can be formed of various materials appropriate for creating a water-tight seal and is relatively flexible. Further, the membrane 104 can have a circular or substantially circular shape, defining an outer diameter greater than an expected diameter of the outlet port 18. As mentioned above, outlet ports of most toilet bowls have a diameter of either 3 or 4 inches. With this in mind, in some embodiments, the membrane 104 has a diameter of at least 4 inches so as to be universally applicable to most toilet bowls.

The mounting assembly 106 can assume various forms appropriate for attaching the shield system 100 to the toilet bowl 10. For example, in some embodiments, the mounting assembly 106 includes two (or more) threaded bolts 110. The threaded bolts 110 can be permanently attached to the support assembly 102, or can be separately provided and assembled thereto by the user. Regardless, upon final construction, the threaded bolts 110 extend from the support assembly 102 and the membrane 104 at locations relative to one another that correspond with the standardized relationship of the bolt holes 28 (FIG. 2) in the toilet bowl base 22; for example, the threaded bolts 110 are located at a center-to-center distance of approximately 6 inches. With this construction, the threaded bolts 110 can be inserted through respective ones of the bolt holes 28; nuts 112 provided with the mounting assembly 106 are then applied to corresponding ones of the threaded bolts 110 to secure the shield system 100 to the toilet bowl 10, with the membrane 104 abutting the outlet port 18 in a liquid tight manner.

Upon final assembly to the toilet bowl 10, the shield system 100 covers the outlet port 18 and surrounding areas. An overall thickness of the support assembly 102 and the membrane 104 is, in some embodiments, selected to approximate or be less than a depth of the open interior region 24 (best seen in FIG. 2) of the base 22. With these and related embodiments, the support assembly 102 and the membrane 104 thus nest within the base 22, allowing the toilet bowl 10 to be readily stored in an upright fashion, with the base 22 placed on the floor of the storage location if desired by the user (e.g., in some examples, the mounted shield system 100 does not interfere with the base 22 resting flush against a flat floor; in other embodiments of the present disclosure, an entirety of the mounted shield system 100 need not necessarily nest within the base 22 such that when stored upright, the base 22 abuts a surface of the mounted shield system 100 that in turn rests against the flat floor). It will be understood, however, that the toilet bowl 10 can be stored in a variety of other orientations. For example, the toilet bowl 10 can be laid on its side (noting that in this orientation, water might leak out of the bowl reservoir 12 (FIG. 1), but will not leak out of the outlet port 18). In some instances, a thickness of the support assembly 102 may be less than a length of outlet port 18; under these circumstances, as the support assembly 102 forced toward the base 22 (with tightening of the nuts 112), the membrane 104 is driven beyond the terminal end of the outlet port 18. This desired mounting approach continues, with a central portion of the membrane 104 deflecting into the clearance aperture 108. In other words, a length of the outlet port 18 is readily accommodated by a flexibility of the membrane 104 and presence of the clearance aperture 108, allowing the membrane 104 to be installed tightly against the outlet port 18.

The installed shield system 100 prevents any wax ring otherwise residue adhering to the toilet bowl 10 about the outlet port 18 from transferring onto the floor or other surfaces of the storage location. Further, the membrane 104 prevents water contained within the bend region 20 from spilling or draining from the outlet port 18 as the toilet bowl 10 is moved, jostled, etc.

Figure 4A:
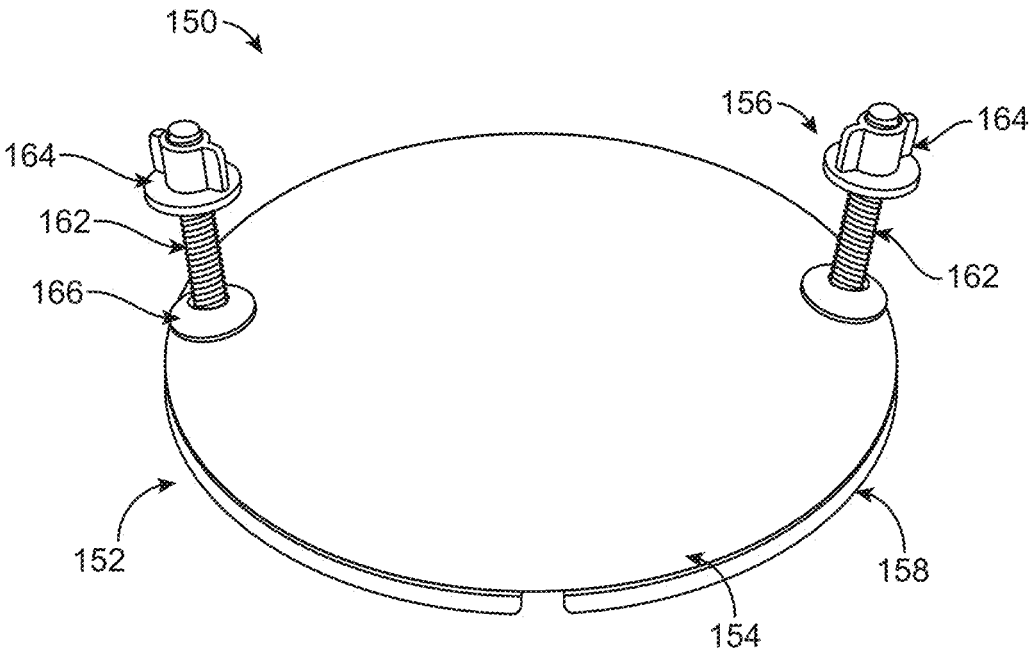
FIG. 4A is a top perspective view of a shield system in accordance with principles of the present disclosure.
Figure 4B:
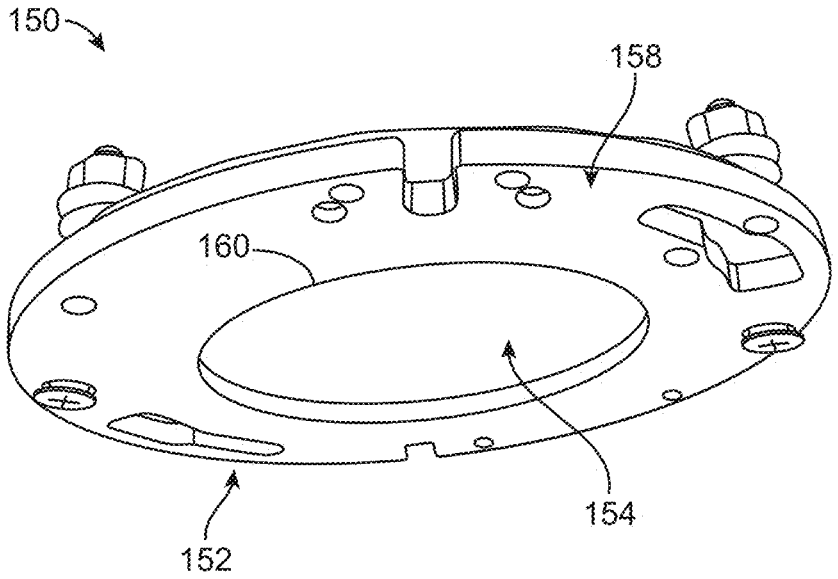
FIG. 4B is a bottom perspective view of the shield system of FIG. 4A.

One example of a shield system 150 in accordance with principles of the present disclosure, and useful as the shield system 100 (FIG. 3), is shown in FIGS. 4A and 4B. The shield system 150 includes a support assembly 152, a membrane 154, and a mounting assembly 156 (referenced generally). As a point of reference, while FIGS. 4A and 4B illustrate the mounting assembly 156 attached to the support assembly 152 (and thus the membrane 154), in some embodiments the shield system 150 as initially provided to a user includes the mounting assembly 156 apart from the support assembly 152 and the membrane 154 (e.g., during use, a user connects the mounting assembly 156 to the support assembly 152). Though not shown, as initially provided to a user, the shield system 150 can further include packaging containing the support assembly 152, the membrane 154 and the mounting assembly 156 (along with other, optional articles, such as written instructions for use).

The support assembly 152 includes a base piece 158 provided as a flat, ring- or disc-shaped body formed of a structurally robust material, such as plastic (e.g., PVC), metal, etc. An outer diameter of the base piece 158 can be greater than the expected toilet bowl bolt hole 28 (FIG. 2) separation distance (e.g., 6 inches as described above), for example on the order of 7 inches although other dimensions are also acceptable. The base piece 158 forms or defines a clearance aperture 160 as described above.

The membrane 154 is a thin body, formed of a material selected to be impervious to water. For example, the membrane 154 can be rubber, or other materials conventionally used for water sealing membranes. In some embodiments, a shape of the membrane 154 generally matches a perimeter shape of the base piece 158. Thus, the membrane 154 can be circular, with a diameter on the order of 7 inches. Other shapes and dimensions are also acceptable; in some embodiments, however, a size and shape of the membrane 154 is selected to approximate or be greater than the expected shape and size (e.g., diameter) of a toilet bowl outlet port as described above. Regardless, the membrane 154 can be connected to the support assembly 152 in various manners. For example, the membrane 154 can be adhered, welded or otherwise attached to an upper surface of the base piece 158. In other embodiments, the membrane 154 can be more loosely secured relative to the base piece 158, for example via one non-limiting embodiment of the mounting assembly as described below.

The mounting assembly 156 can have any of the descriptions above, and in some embodiments includes two threaded bolts 162 and corresponding nuts 164. In some embodiments, the threaded bolts 162 are initially apart from the support assembly 152 (and the membrane 154). With these and related embodiments, the base piece 158 (and the membrane 154) define receiving holes through which the threaded bolts 162 can be inserted. In other embodiments, the threaded bolts 162 can be permanently attached to, or optionally integrally formed with, the base piece 158. Regardless, the threaded bolts 162 are retained relative to the base piece 158 (and the membrane 154) at locations (relative to one another) that correspond with the standardized relationship of the bolt holes 28 (FIG. 2) in the toilet bowl base 22; for example, the threaded bolts 162 are located at a center-to-center distance of approximately 6 inches. In some embodiments, the mounting assembly 156 can further include a washer 166 (e.g., tapered plastic washer) received over a corresponding one of the threaded bolts 162 as shown.

Figure 5A:
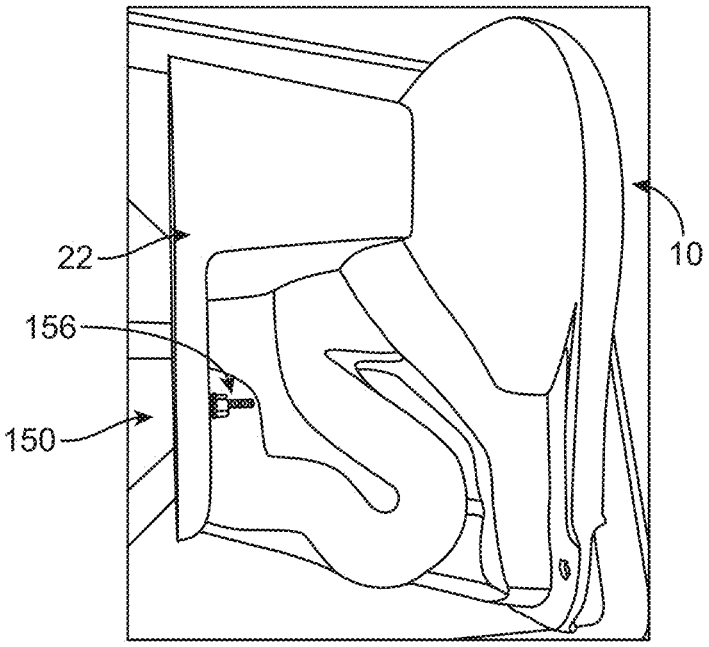
FIG. 5A illustrates assembly of the shield system of FIG. 4A to a toilet bowl.
Figure 5B:
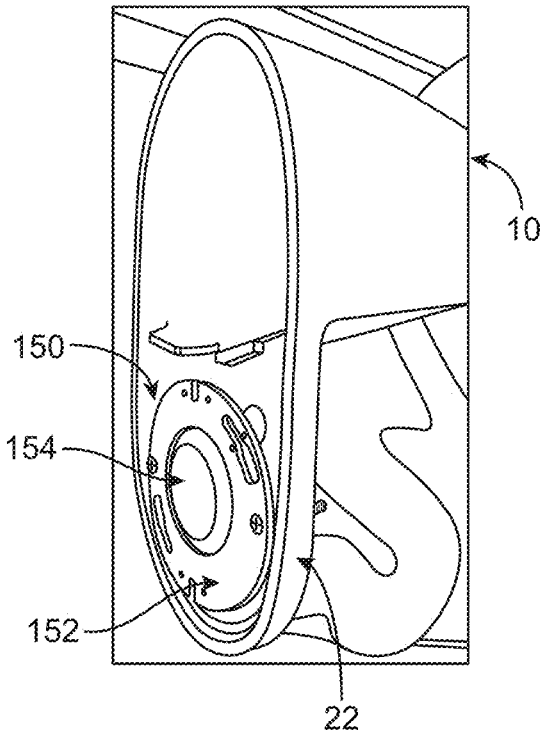
FIG. 5B is an enlarged view of a portion of the arrangement of FIG. 5A.
Figure 5C:
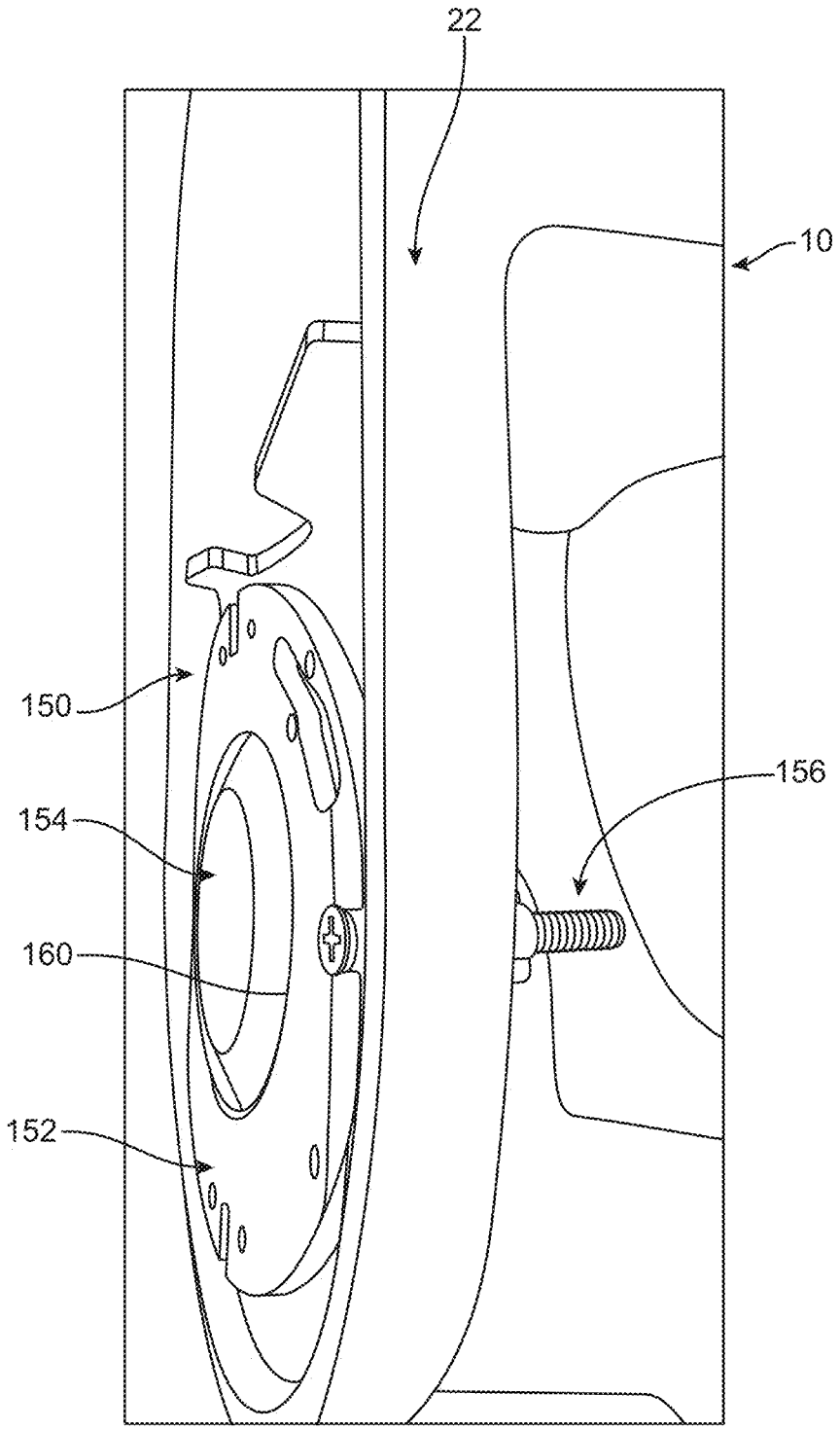
FIG. 5C is a further enlarged view of a portion of the arrangement of FIG. 5A.

The shield system 150 can be assembled to a toilet bowl in accordance with the descriptions above. In this regard, FIGS. 5A-5C depict final assembly of the shield system 150 to the toilet bowl 10 (as a point of reference, the toilet bowl 10 is laid on its side in the views for ease of understanding). As shown, the mounting assembly 156 has been manipulated to force the support assembly 152 into the base 22, securing the membrane 154 tightly against the outlet port 18 (hidden in the views). In this regard, a flexibility of the membrane and the clearance aperture 160 serve to accommodate a length of the outlet port 18, with a portion of the outlet port 18 readily residing within the clearance aperture 160.

Figure 6A:
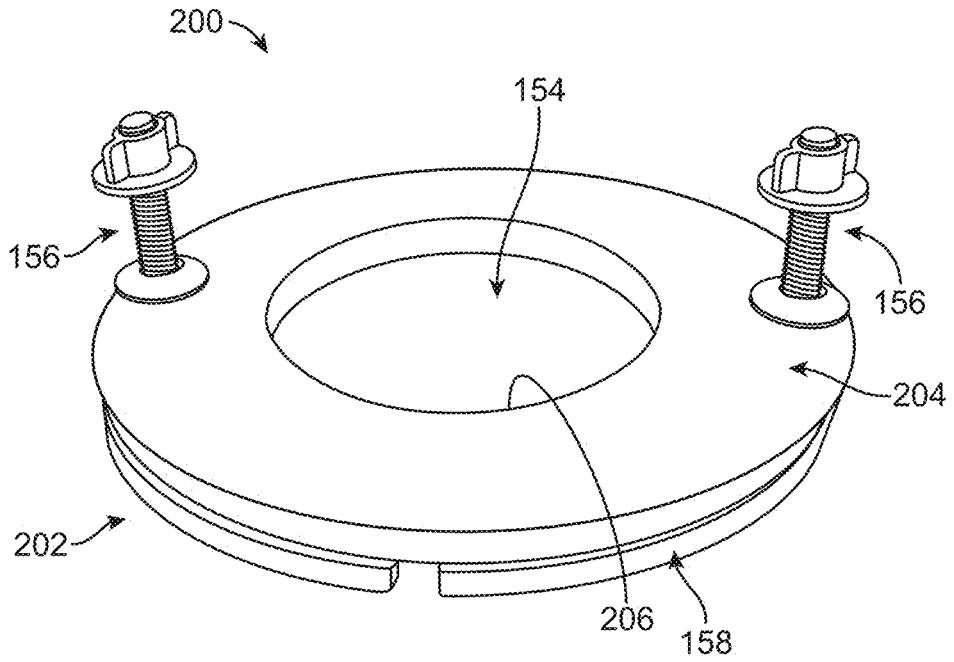
FIG. 6A is a top perspective view of a shield system in accordance with principles of the present disclosure.
Figure 6B:
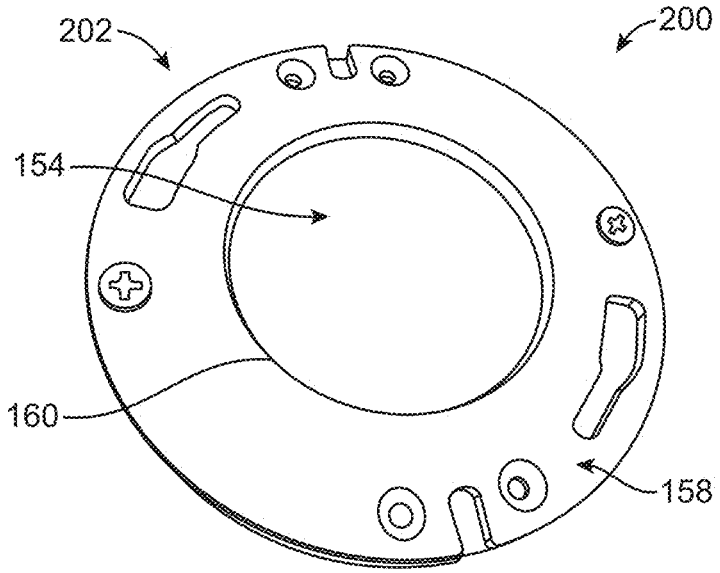
FIG. 6B is a bottom perspective view of the shield system of FIG. 6A.

Another embodiment of a shield system 200 in accordance with principles of the present disclosure, and useful as the shield system 100 (FIG. 3), is shown in FIGS. 6A and 6B. The shield system 200 includes the membrane 154 and the mounting assembly 156 (referenced generally) as described above, along with a support assembly 202. As with previous embodiments, as initially provided to a user, the mounting assembly 156 can be apart from the support assembly 202 or the threaded bolts can be pre-installed. Further, the shield system 200 can optionally include packaging containing the components (and optional written instructions for use). Regardless, the support assembly 202 can be akin to the support assembly 152 (FIGS. 4A and 4B) and can include the base piece 158 as previously described. In addition, the support assembly 202 includes a spacer body 204. The spacer body 204 can assume various forms, and generally has a ring-like shape defining a central opening 206. The spacer body 204 is configured for placement against a structure of a toilet bowl base (e.g., the shoulder 26 shown in FIG. 2), and is formed of a compliant material (e.g., foam with optional water repellant properties) with a stiffness generally less than that of the base piece 158. As shown, the membrane 154 is sandwiched between the spacer body 204 and the base piece 158, with the central opening 206 being generally aligned with the clearance aperture 160.

The shield system 200 can be installed to a toilet bowl to cover the corresponding outlet port 18 (FIG. 2) in manners consistent with the descriptions above. The base piece 158 serves to provide structural support for the membrane 154, whereas the spacer body 204 further accommodates a length of the outlet port 18 via the central opening 206 to improve a likelihood of a liquid tight relationship between the membrane 154 and the outlet port 18. In this regard, water spilling from the outlet port 18 is readily collected in (and retained at) the central opening. Further, the compliant nature of the spacer body 204 can address imperfections in bottom surfaces of the toilet bowl.

Figure 7A:
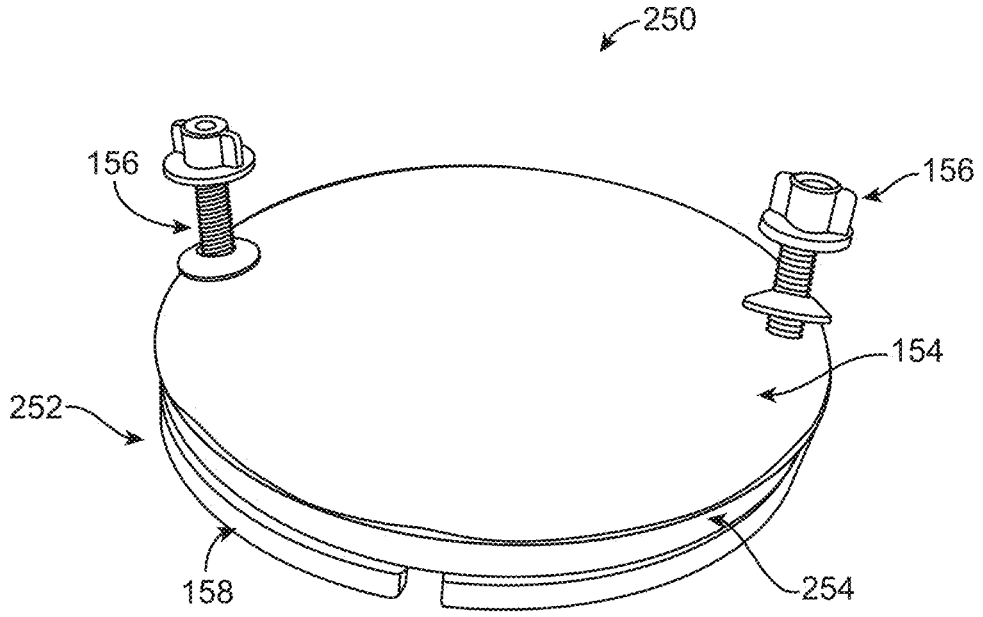
FIG. 7A is a top perspective view of a shield system in accordance with principles of the present disclosure.
Figure 7B:
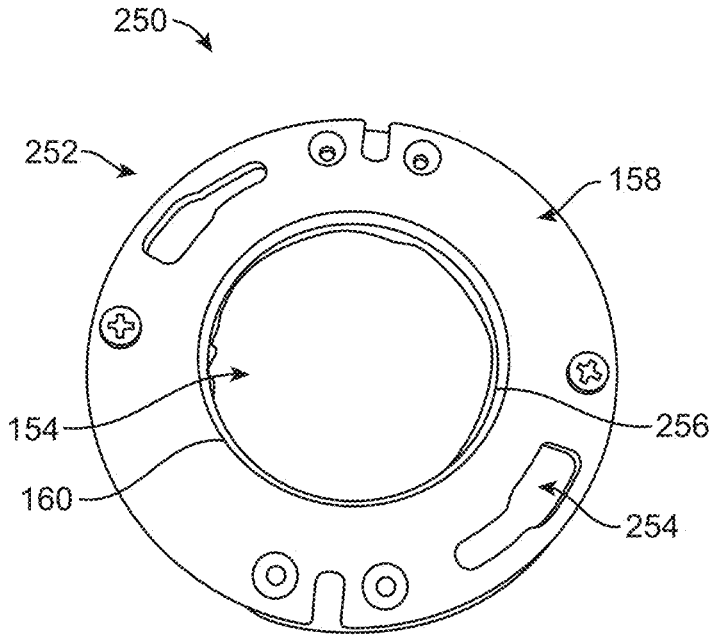
FIG. 7B is a bottom perspective view of the shield system of FIG. 7A.

Another embodiment of a shield system 250 in accordance with principles of the present disclosure, and useful as the shield system 100 (FIG. 3), is shown in FIGS. 7A and 7B. The shield system 250 includes the membrane 154 and the mounting assembly 156 (referenced generally) as described above, along with a support assembly 252. As with previous embodiments, as initially provided to a user, the mounting assembly 156 can be apart from the support assembly 252 or the threaded bolts can be pre-installed. Further, the shield system 250 can optionally include packaging containing the components (and, optional written instructions for use). Regardless, the support assembly 252 can be akin to the support assembly 152 (FIGS. 4A and 4B) and can include the base piece 158 as previously described.

In addition, the support assembly 252 includes a spacer body 254. The spacer body 254 can assume various forms, and generally has a ring-like shape defining a central opening 256 (referenced generally in FIG. 7B). The spacer body 254 is configured to resiliently support the membrane 154 when pressed against a structure of a toilet bowl (e.g., the outlet port 18 (FIG. 2)), and is formed of a compliant material (e.g., foam with optional water repellant properties) with a stiffness generally less than that of the base piece 158. As shown, the membrane 154 is secured to the spacer body 254 (e.g., adhesive, weld, etc.) opposite the base piece 158, with the central opening 256 being generally aligned with the clearance aperture 160.

The shield system 250 can be installed to a toilet bowl to cover the corresponding outlet port 18 (FIG. 2) in manners consistent with the descriptions above. The base piece 158 serves to provide structural support for the membrane 154. The spacer body 254 accommodates a length of the outlet port 18 via the central opening 256 and the compliant nature of the spacer body 254 can address imperfections in bottom surfaces of the toilet bowl.

Figure 8A:
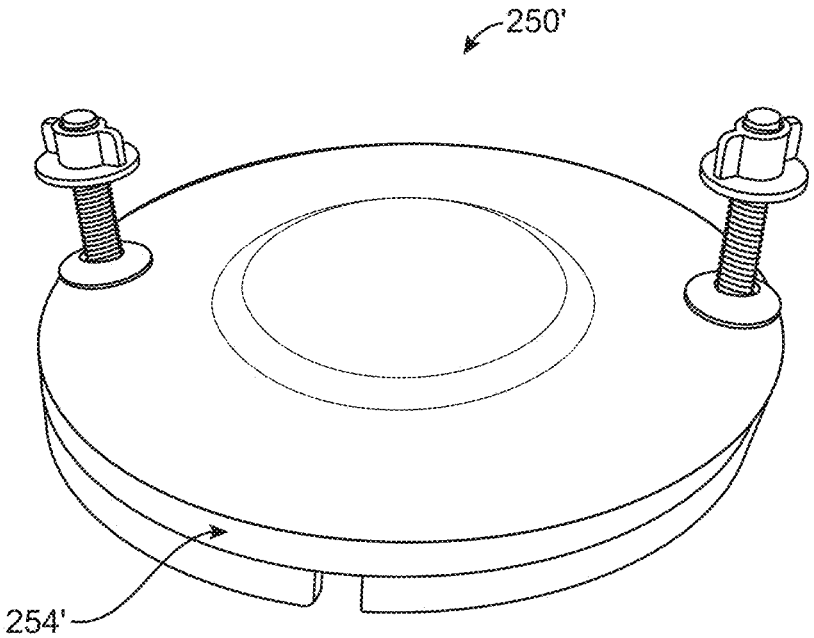
FIG. 8A is a top perspective view of a shield system in accordance with principles of the present disclosure.
Figure 8B:
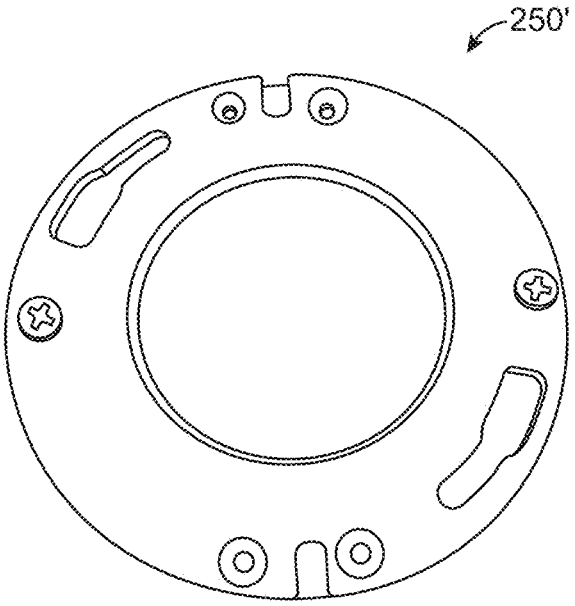
FIG. 8B is a bottom perspective view of the shield system of FIG. 8A.

The spacer body 254 can be formed from a variety of compliant-type materials. For example, the views of FIGS. 8A and 8B illustrate a related embodiment shield system 250' employing a spacer body 254' formed of a foam material differing from that of the spacer body 254 (FIGS. 7A and 7B).

Figure 9A:
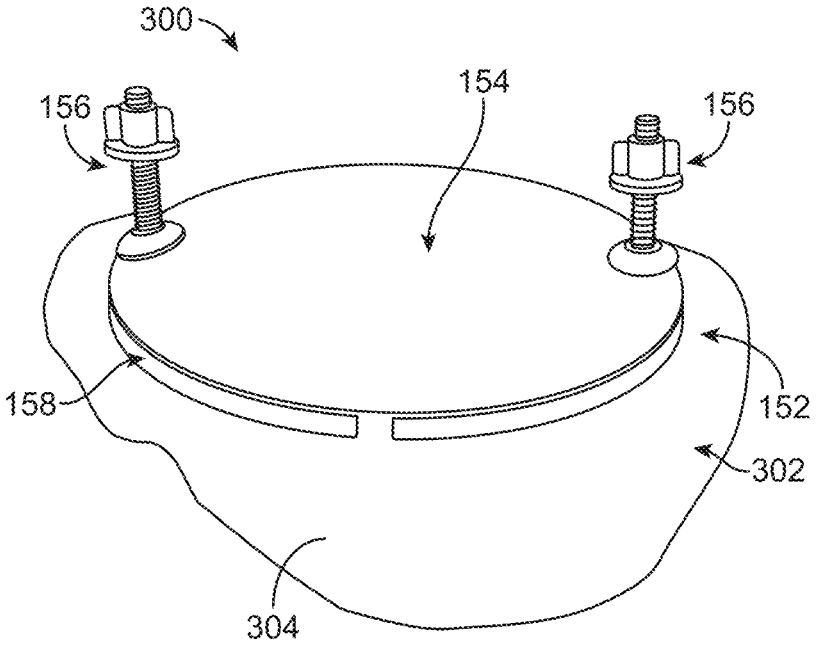
FIG. 9A is a top perspective view of a shield system in accordance with principles of the present disclosure.
Figure 9B:
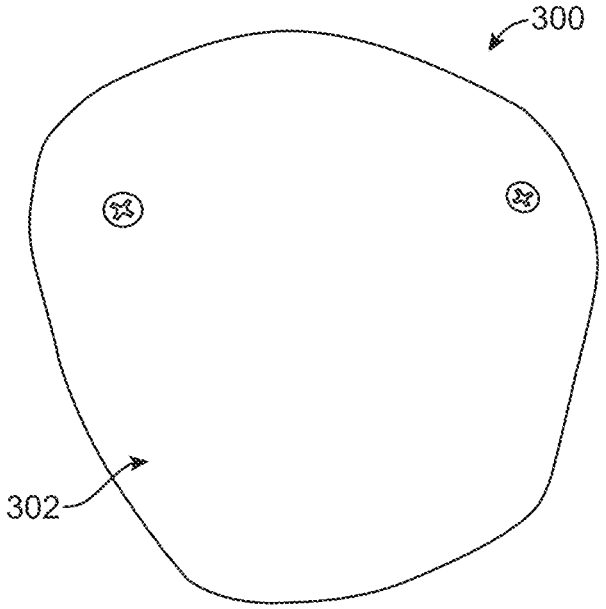
FIG. 9B is a bottom perspective view of the shield system of FIG. 9A.

Another embodiment of a shield system 300 in accordance with principles of the present disclosure, and useful as the shield system 100 (FIG. 3), is shown in FIGS. 9A and 9B. The shield system 300 includes the support assembly 152, the membrane 154 and the mounting assembly 156 (referenced generally) as described above, along with a protective layer 302. As with previous embodiments, as initially provided to a user, the mounting assembly 156 can be apart from the support assembly 152 or at least the threaded bolts can be pre-installed. Further, the shield system 300 can optionally include packaging containing the components (and, optional written instructions for use). Regardless, the protective layer 302 can be included with any of the embodiments of the present disclosure, and is generally a thin flexible body formed of a water repellant material (e.g., akin to a rubber gasket material). The protective layer 302 is configured to provide additional floor coverage/protection upon final assembly of the shield system 300 to the toilet bowl. In some embodiments, the protective layer 302 is assembled to the base piece 158 opposite the membrane 154, and has a size or shape that is greater than that of the base piece 158. For example, the protective layer 302 can form or define a lip region 304 that projects laterally from the base piece 158 for placement, for example, under the toilet bowl base 22 (FIG. 1). The shield system 300 can be installed to a toilet bowl to cover the corresponding outlet port 18 (FIG. 2) in manners consistent with the descriptions above. Following installation and when stored in an upright fashion, the toilet bowl base 22 may rest on the protective layer 302 that in turn contacts or lies on the ground.

Figure 10A:
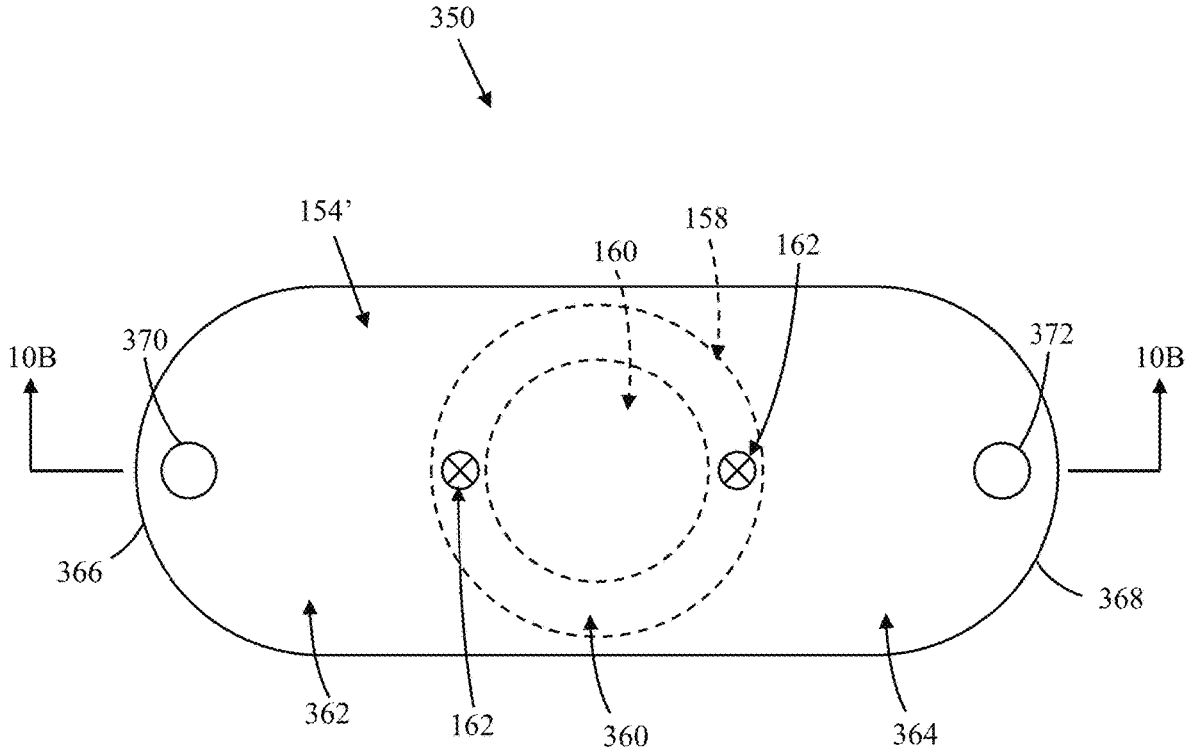
FIG. 10A is a simplified top view of a shield system in accordance with principles of the present disclosure.
Figure 10B:
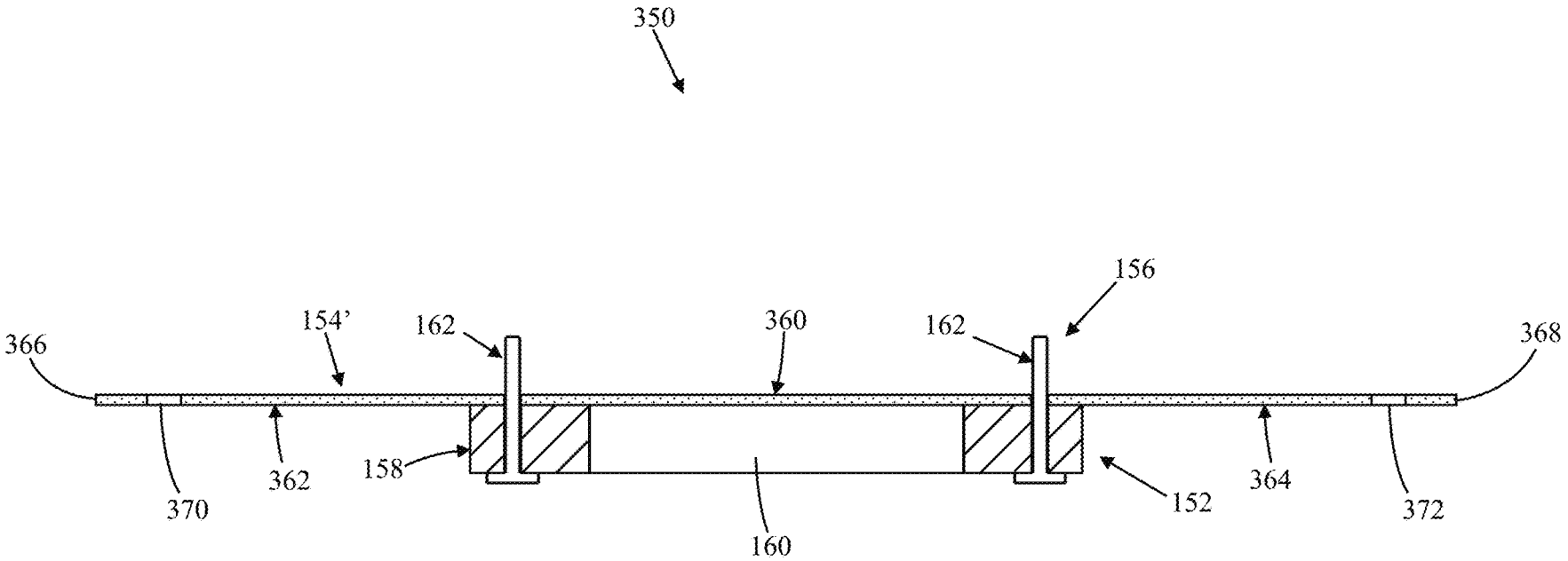
FIG. 10B is a simplified cross-sectional view of the shield system of FIG. 10A, taken along the line 10B-10B.

Another embodiment of a shield system 350 in accordance with principles of the present disclosure, and useful as the shield system 100 (FIG. 3), is shown in FIGS. 10A and 10B. The shield system 350 includes the support assembly 152 and the mounting assembly 156 (referenced generally) as described above, along with a membrane 154'. As with previous embodiments, as initially provided to a user, the mounting assembly 156 can be apart from the support assembly 152 or at least the threaded bolts can be pre-installed.

The membrane 154' can be akin to the membrane 154 (FIG. 4A) in terms of material and construction. For example, the membrane 154' is a thin body, formed of a material selected to be impervious to water. In some embodiments, the membrane 154' can be rubber, or other materials conventionally used for water sealing membranes.

In some embodiments, the membrane 154' is sized and shaped to define a central region 360 and opposing flap regions 362, 364. The central region 360 is sized and shaped in accordance with a perimeter shape of the base piece 158, and in particular to extend across the base piece 158 and cover the clearance aperture 160. As with previous embodiments, the central region 360 is sized and shaped to approximate or be greater than the expected shape and size (e.g., diameter) of a toilet bowl outlet port. The flap regions 362, 364 extend in opposite directions from the central region 360. As reflected by the initial state (e.g., prior to assembly to a toilet bowl base) of FIGS. 10A and 10B in which the central region 360 is positioned over the base piece 158, the flap regions 362, 364 project beyond the base piece 158 to a corresponding edge 366, 368. A hole 370 is formed through a thickness of the membrane 154' in the first flap region 362 near the edge 366, and a hole 372 is formed through a thickness of the membrane 154' in the second flap region 364 near the edge 368. The holes 370, 372 are each sized to be received over a corresponding one of the threaded bolts 162 as described in greater detail below. The membrane 154' can be connected to the support assembly 152 in various manners. For example, the membrane 154' can be adhered, welded or otherwise attached to an upper surface of the base piece 158. In other embodiments, the membrane 154' can be more loosely secured relative to the base piece 158, for example via one non-limiting embodiment of the mounting assembly 156 as described above.

Figure 11:
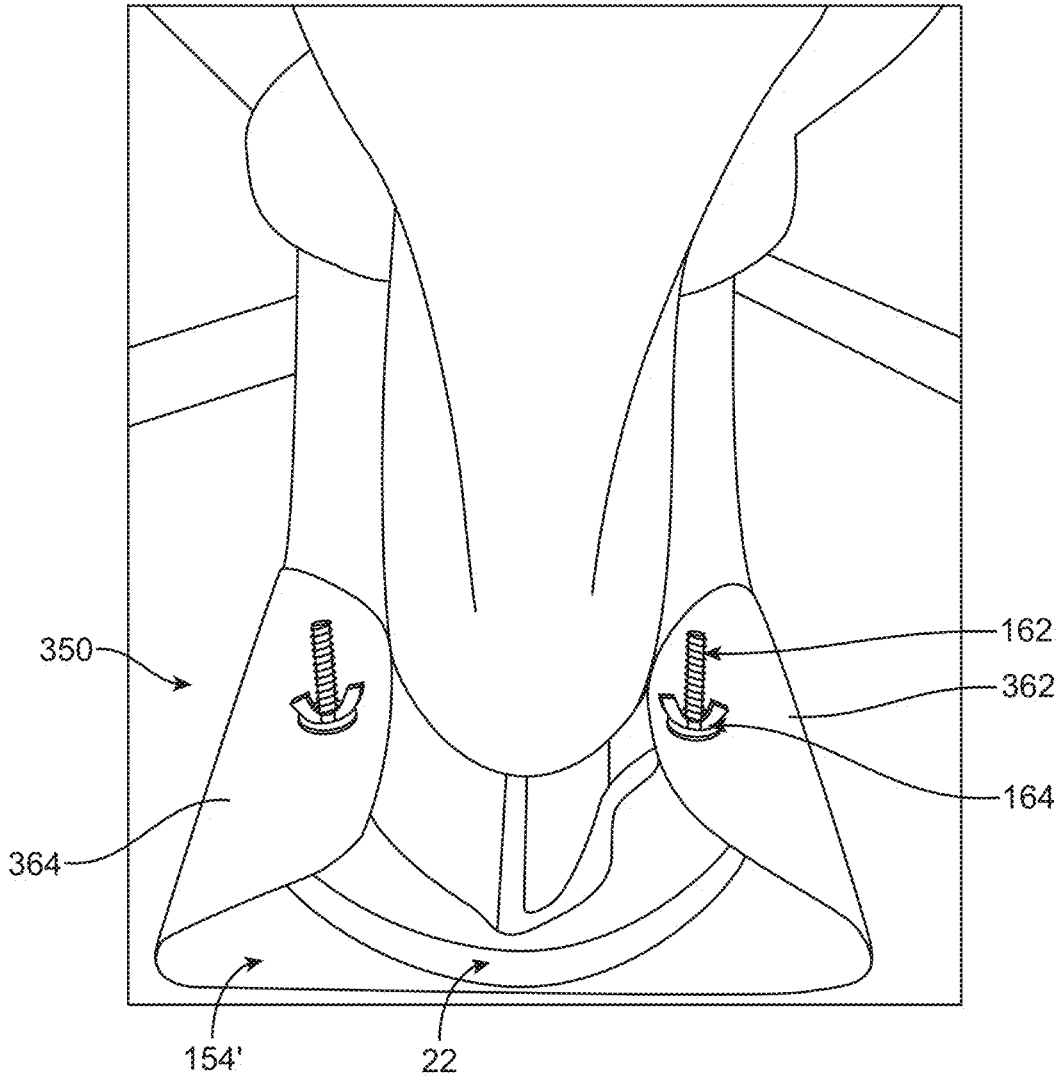
FIG. 11 is a perspective view of the shield system of FIG. 10A installed to a toilet.

The shield system 350 can be installed to a toilet bowl to cover the corresponding outlet port 18 (FIG. 2) in manners consistent with the descriptions above. In general terms, the threaded bolts 162 are inserted through the bolt holes 28 (FIG. 2), aligning the support assembly 152 with the outlet port 18. As shown in FIG. 11, the opposing flap regions 362, 364 are then wrapped over the base 22, and secured over a respective one of the threaded bolts 162 (via the corresponding hole 370, 372 (FIGS. 10A and 10B)). The nuts 164 are then secured to the bolts 162, securing the central region 360 (FIGS. 10A and 10B) of the membrane 154' tightly against the outlet port 18 (hidden in the view of FIG. 11). The now wrapped and secured flap regions 362, 364 prevent wax or other debris on the base 22 from oozing onto the floor.

Although the present disclosure has been described with reference to preferred embodiments, workers skilled in the art will recognize that changes can be made in form and detail without departing from the spirit and scope of the present disclosure.

What is claimed is:

1. A shield system for installation to a toilet bowl for temporarily covering an outlet port of the toilet bowl, the shield system comprising:

a support assembly including a base piece defining a central aperture sized to receive an outlet port of a toilet bowl;

a membrane connected to the base piece and extending across the central aperture;

a mounting assembly configured to secure the support assembly to the toilet bowl in an installed arrangement of the shield system to the toilet bowl.

2. The shield system of claim 1, wherein the base piece is ring-shaped.

3. The shield system of claim 1, wherein a diameter of the central aperture is configured to be greater than a diameter of the outlet port of a toilet bowl.

4. The shield system of claim 1, wherein a diameter of the central aperture is at least 3 inches.

5. The shield system of claim 1, wherein the mounting assembly includes first and second bolts projecting from the base piece.

6. The shield system of claim 5, wherein the first and second bolts are located at opposite sides of the central aperture.

7. The shield system of claim 5, wherein a center-to-center distance between the first and second bolts is 6 inches in the installed arrangement of the shield system.

8. The shield system of claim 1, wherein the membrane is sized and shaped to extend across the outlet port in the installed arrangement.

9. The shield system of claim 1, wherein the membrane device comprises a central region and opposing flap regions.

10. The shield system of claim 9, wherein the central region is sized and shaped to extend across the outlet port in the installed arrangement and further wherein the opposing flap regions are sized and shaped to wrap around a base of the toilet bowl in the installed arrangement.

11. The shield system of claim 1, wherein the support assembly further includes a spacer body secured to the base piece.

12. The shield system of claim 11, wherein the spacer body is formed of a compliant material and has a stiffness less than a stiffness of the base piece.

13. The shield system of claim 1, further comprising:

a protective layer assembled to the base piece opposite the membrane.

14. The shield system of claim 13, wherein a size of the protective layer is greater than a size of the base piece.

15. The shield system of claim 14, wherein the protective layer defines a lip region that projects laterally from the base piece for placement under a base of the toilet bowl in the installed arrangement.

16. A method of temporarily covering an outlet port of the toilet bowl with the shield system of claim 1, the method comprising:

aligning the base piece with the outlet port of the toilet bowl, including the membrane facing the outlet port; and manipulating the mounting assembly to secure the shield system to the toilet bowl, including the membrane abutting the outlet port in a liquid tight manner.

17. The method of claim 16, wherein the mounting assembly includes first and second bolts, and further wherein the step of aligning includes inserting the first and second bolts through corresponding bolt holes in a base of the toilet bowl.

18. The method of claim 17, wherein membrane defines a central region and opposing flap regions, and wherein prior to the step of manipulating, the method further comprising:

wrapping the opposing flap regions over a base of the toilet bowl.

19. The method of claim 16, wherein the step of manipulating forces the base piece toward the outlet port and includes a central portion of the membrane deflecting into the clearance aperture.

* * * * *